US011959647B2

(12) United States Patent
Bush

(10) Patent No.: US 11,959,647 B2
(45) Date of Patent: Apr. 16, 2024

(54) AIR-CONDITIONING UNIT HAVING A COIL WITH AN ACTIVE PORTION AND AN INACTIVE PORTION

(71) Applicant: Mitsubishi Electric US, Inc., Cypress, CA (US)

(72) Inventor: Joseph Paul Bush, Lawrenceville, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 0 days.

(21) Appl. No.: 18/180,299

(22) Filed: Mar. 8, 2023

(65) Prior Publication Data

US 2023/0221011 A1 Jul. 13, 2023

Related U.S. Application Data

(62) Division of application No. 17/559,497, filed on Dec. 22, 2021, now Pat. No. 11,624,513, which is a (Continued)

(51) Int. Cl.
*F24F 1/0041* (2019.01)
*F24F 1/0063* (2019.01)
(Continued)

(52) U.S. Cl.
CPC ..... *F24F 1/0041* (2019.02); *F24F 1/0063* (2019.02); *F24F 1/009* (2019.02);
(Continued)

(58) Field of Classification Search
CPC ..... F24F 1/0041; F24F 12/006; F24F 1/0063; F24F 1/01; F24F 2012/007
(Continued)

(56) References Cited

U.S. PATENT DOCUMENTS 2,139,297 A * 12/1938 Bergdoll ..... F25B 41/335 62/526
5,906,107 A * 5/1999 Takahashi ..... F25B 13/00 165/101
(Continued)

FOREIGN PATENT DOCUMENTS

CN 101915450 A 12/2010
CN 103353147 B 5/2016
WO 2015/135025 A2 9/2015

*Primary Examiner* — Steve S Tanenbaum
(74) *Attorney, Agent, or Firm* — POSZ LAW GROUP, PLC

(57) ABSTRACT

An air-conditioning unit is provided, comprising: an input vent for receiving return air; an intermediate vent; an output vent; a blower fan proximate to the input vent for moving the return air from the input vent to the intermediate vent; and an air-conditioner coil between the intermediate vent and the output vent including an active portion including one or more operational air-conditioning coils that receive a first portion of the return air from the intermediate vent, for circulating a coolant, condition the first portion of the return air by heat exchange with the coolant to create conditioned air, and pass the conditioned air to the output vent, and an inactive portion that does not circulate coolant and passes a second portion of the return air as unconditioned air to the output vent, wherein the conditioned air and the unconditioned air pass through the output vent as supply air.

20 Claims, 7 Drawing Sheets

Related U.S. Application Data division of application No. 16/730,130, filed on Dec. 30, 2019, now Pat. No. 11,248,806.

(51) Int. Cl.

| | |
|---|---|
| ***F24F 1/009*** | (2019.01) |
| ***F24F 1/01*** | (2011.01) |
| ***F24F 7/007*** | (2006.01) |
| ***F24F 11/873*** | (2018.01) |
| ***F24F 12/00*** | (2006.01) |

(52) U.S. Cl.

CPC ..... *F24F 1/01* (2013.01); *F24F 7/007* (2013.01); *F24F 11/873* (2018.01); *F24F 12/006* (2013.01); *F24F 2012/007* (2013.01)

(58) Field of Classification Search

USPC ..... 62/117

See application file for complete search history.

(56) References Cited

U.S. PATENT DOCUMENTS

| | | | |
|---|---|---|---|
| 6,085,834 | A | 7/2000 | Thomas et al. |
| 10,101,054 | B2 | 10/2018 | Huang |
| 2009/0013715 | A1 | 1/2009 | Setoguchi et al. |

* cited by examiner

AIR-CONDITIONING UNIT HAVING A COIL WITH AN ACTIVE PORTION AND AN INACTIVE PORTION

CROSS REFERENCE TO RELATED APPLICATIONS

The present application is a divisional application of U.S. Utility Application No. 17/559,497 filed on Dec. 22, 2021, which is a divisional application of U.S. Utility Application No. 16/730,130 filed on Dec. 30, 2019, now U.S. Pat. No. 11,248,806 issued on Feb. 15, 2022, the disclosures of which are incorporated herein by reference.

FIELD OF THE INVENTION

The disclosed system and method relate generally to indoor air-conditioning units that include an air-conditioning coil that conditions return air to form supply air. More particularly, the disclosed system and method relate to a comparatively small capacity indoor air-conditioner with a high latent capacity but a relatively high airflow.

BACKGROUND OF THE INVENTION

Demand for variable refrigerant flow (VRF) and split ductless air-conditioning (AC) systems for passive buildings is growing. In addition to providing insulation, keeping the building relatively airtight, and employing high-performance windows and doors, these passive structures divide a living or working area into multiple zones that are heated or cooled individually.

A split ductless AC system includes an outdoor unit that cools or heats a refrigerant and then provides that refrigerant through a refrigerant pipe to separate indoor split AC units within individual zones in a building. Each split AC unit operates like a miniature air handler, delivering hot or cold air into its designated zone only when it's needed. In this way a split AC unit need only operate when it is necessary to heat or cool its designated zone, thus providing energy savings for the AC system as a whole.

VRF units support variable motor speeds and variable refrigerant flows rather than simply turning on and off. Since they can operate at variable speeds, VRF units can vary their rate to be only as high as necessary, allowing for energy savings for lower air-conditioning loads. Furthermore, individual VRF units in a single building can operate in heating or cooling modes as required. This allows for greater control of the temperature within a building with multiple VRF units.

In such a passive building, the individual indoor AC units may have extremely small loads that need to be heated and cooled compared to those serviced by traditional AC units. As a result, relatively small capacity indoor units are required for these indoor spaces. However, there are practical limits on how small an indoor unit can be made. As a result, in the smallest traditional indoor units currently available, overheating, short cycling, and humidity control issues are common.

One technique currently used to reduce the capacity of an indoor unit is to lower the capacity of the refrigerant evaporator (DX) coil in the indoor unit but keep the same airflow. However, while maintaining the same airflow is good for air circulation, the reduction of the capacity can cause problems with latent removal, i.e., the removal of moisture from the circulated air. For example, this can be implemented by keeping a coil size the same but raising average coil temperature. However, if the average coil temperature gets too high, the coil won't operate to efficiently remove humidity from the air in its assigned zone.

Another option to reduce the capacity of the indoor unit is to maintain the capacity of the DX coil but reduce the airflow through the indoor unit. However, if the airflow of an indoor unit is reduced proportionally with the reduction of the indoor unit's capacity, the airflow may not provide enough air circulation for adequate air flow within a relatively large zone. Often the low-load zones serviced by these sorts of indoor units are relatively sizeable relative to their low heating and cooling load. As a result, it is necessary to provide a relatively high level of airflow to properly circulate air through the entire zone. This is especially important if the indoor unit is a wall mount that needs to throw heated air from a relatively high mounting position on a wall down to the floor.

It would therefore be desirable to provide an indoor unit that has a lower capacity of cooling and heating but still both maintains a sufficiently high airflow to circulate air within the assigned zone and can adequately remove moisture from the air in the zone.

SUMMARY OF THE INVENTION

An air-conditioning unit is provided, comprising: an input vent configured to receive return air; an intermediate vent; an output vent; a blower fan configured to move the return air from the input vent to the intermediate vent; and an air-conditioner coil located between the intermediate vent and the output vent including an active portion including one or more operational air-conditioning coils configured to receive a first portion of the return air from the intermediate vent, to circulate a coolant, to condition the first portion of the return air by heat exchange with the coolant to create conditioned air, and to pass the conditioned air to the output vent, and an inactive portion that does not circulate the coolant and that is configured to pass a second portion of the return air as unconditioned air to the output vent, wherein the conditioned air and the unconditioned air are passed through the output vent as supply air.

Each of the one or more operational air-conditioning coils may include a plurality of active coil sections, and each of the plurality of active coil sections may include a plurality of operational refrigerant tubes connected together and configured to pass coolant.

Each of the plurality of active coil sections may include a same number of operational refrigerant tubes.

The active portion may include a plurality of first conductive fins arranged in a substantially parallel arrangement, and at least one active coil configured to pass through the plurality of first conductive fins, configured to be in a conductive relationship with the plurality of first conductive fins, and configured to circulate coolant, the inactive portion may include a plurality of second conductive fins arranged in a substantially parallel arrangement, and no coils may pass through the plurality of second conductive fins.

The active portion may include two or more operational air-conditioning coils, each of the two or more operational air-conditioning coils may include a plurality of active coil sections, and each of the plurality of active coil sections may include a plurality of operational refrigerant tubes connected together and configured to pass coolant.

The active portion may include two or more operational air-conditioning coils, the inactive portion may include two or more inactive coil sections, and each of the two or more inactive coil sections may include at least one non-operational refrigerant tube that does not pass coolant.

The conditioned air and the unconditioned air may be mixed together to form the supply air.

The air-conditioning unit may further comprise: an air mixer configured to mix the unconditioned air and the conditioned air to generate the supply air.

An air-conditioning unit is provided, comprising: an input vent configured to receive return air; an intermediate vent; an output vent; a blower fan configured to move the return air from the input vent to the intermediate vent; an air-conditioner coil located between the intermediate vent and the output vent including one or more operational air-conditioning coils configured to receive a first portion of the return air from the intermediate vent, to circulate a coolant, to condition the first portion of the return air by heat exchange with the coolant to create conditioned air, and to pass the conditioned air to the output vent, and a bypass vent configured to pass a second portion of the return air as unconditioned air to the output vent, wherein the conditioned air and the unconditioned air are passed through the output vent as supply air.

An air-conditioning coil is provided, comprising: an active portion including one or more operational air-conditioning coils configured to receive a first portion of an amount of return air, to circulate a coolant, to condition the first portion of the amount of return air by heat exchange with the coolant to create conditioned air, and to pass the conditioned air at an active-portion output, and an inactive portion that does not circulate the coolant and that is configured to pass a second portion of the amount of return air as unconditioned supply air at an inactive-portion output, wherein the conditioned air and the unconditioned air together form supply air output from the air-conditioning coil.

Each of the one or more operational air-conditioning coils may include a plurality of active coil sections, and each of the plurality of active coil sections may include a plurality of operational refrigerant tubes connected together and configured to pass coolant.

Each of the plurality of active coil sections may include a same number of operational refrigerant tubes.

The active portion may include a plurality of first conductive fins arranged in a substantially parallel arrangement, and at least one active coil configured to pass through the plurality of first conductive fins, configured to be in a conductive relationship with the plurality of first conductive fins, and configured to circulate coolant, the inactive portion may include a plurality of second conductive fins arranged in a substantially parallel arrangement, and no coils may pass through the plurality of second conductive fins.

A method of operating an air-conditioning unit is provided, comprising: receiving return air at a blower fan; moving the return air to an intermediate vent by operating the blower fan; passing a first portion of the return air through an active portion of an air-conditioning coil; conditioning the return air in the active portion of the air-conditioning coil to generate conditioned air; passing a second portion of the return air through an inactive portion of the air-conditioning coil without conditioning as unconditioned air; and passing the conditioned air and the unconditioned air through an output vent as supply air to a target room.

The conditioned air and the unconditioned air may be mixed together to form the supply air.

The passing of the first portion of the return air through the active portion of the air-conditioning coil may include passing the return air past a plurality of connected operational refrigerant tubes, and the conditioning of the return air in the active portion of the air-conditioning coil to generate the conditioned air may include passing coolant through the connected operational refrigerant tubes and exchanging heat between the coolant and the first portion of the return air.

The active portion may include a plurality of active coil sections, and the passing of the first portion of the return air through the active portion of the air-conditioning coil may include passing the return air past each of the plurality of active coil sections.

The plurality of active coil sections may each include a same number of operational refrigerant tubes.

The passing of the first portion of the return air through the active portion of the air-conditioning coil may include passing the first portion of the return air past a first plurality of fins arranged in a substantially parallel arrangement in the active portion of the air-conditioning coil; the conditioning of the return air in the active portion of the air-conditioning coil to generate conditioned air may include circulating coolant through at least one tube in the active portion of the air-conditioning coil, conducting heat along the first plurality of fins from the at least one tube, and exchanging heat between the coolant and the supply air at least in part using the first plurality of fins as a medium of heat exchange; and the passing of the second portion of the return air through the inactive portion of the air-conditioning coil without conditioning may include passing the first portion of the return air past a second plurality of fins arranged in a substantially parallel arrangement in the inactive portion of the air-conditioning coil without exchanging heat between the second portion of the return air and the second plurality of fins.

The passing of the first portion of the return air through the active portion of the air-conditioning coil may include passing the first portion of the return air past two or more operational air-conditioning coils, and the conditioning of the return air in the active portion of the air-conditioning coil to generate conditioned air may include circulating coolant through the two or more operational air-conditioning coils and exchanging heat between the coolant and the supply air adjacent to each of the two or more operational air-conditioning coils.

The passing of the first portion of the return air through the active portion of the air-conditioning coil may include passing the first portion of the return air past two or more operational air-conditioning coils, the conditioning of the return air in the active portion of the air-conditioning coil to generate conditioned air may include circulating coolant through the two or more operational air-conditioning coils, and exchanging heat between the coolant and the first portion of the return air adjacent to each of the two or more operational air-conditioning coils, the passing of the second portion of the return air through the inactive portion of the air-conditioning coil may include passing the second portion of the return air past two or more inactive coil sections, and each of the two or more inactive coil sections may include at least one non-operational refrigerant tube that does not pass coolant.

A method of operating an air-conditioning unit is provided, comprising: receiving return air at a blower fan; moving the return air to an intermediate vent; passing a first portion of the return air through an air-conditioning coil; conditioning the return air in the air-conditioning coil to generate conditioned air; passing a second portion of the return air through a bypass vent as unconditioned air; and passing the conditioned and unconditioned return air through an output vent as supply air.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Figure 1:
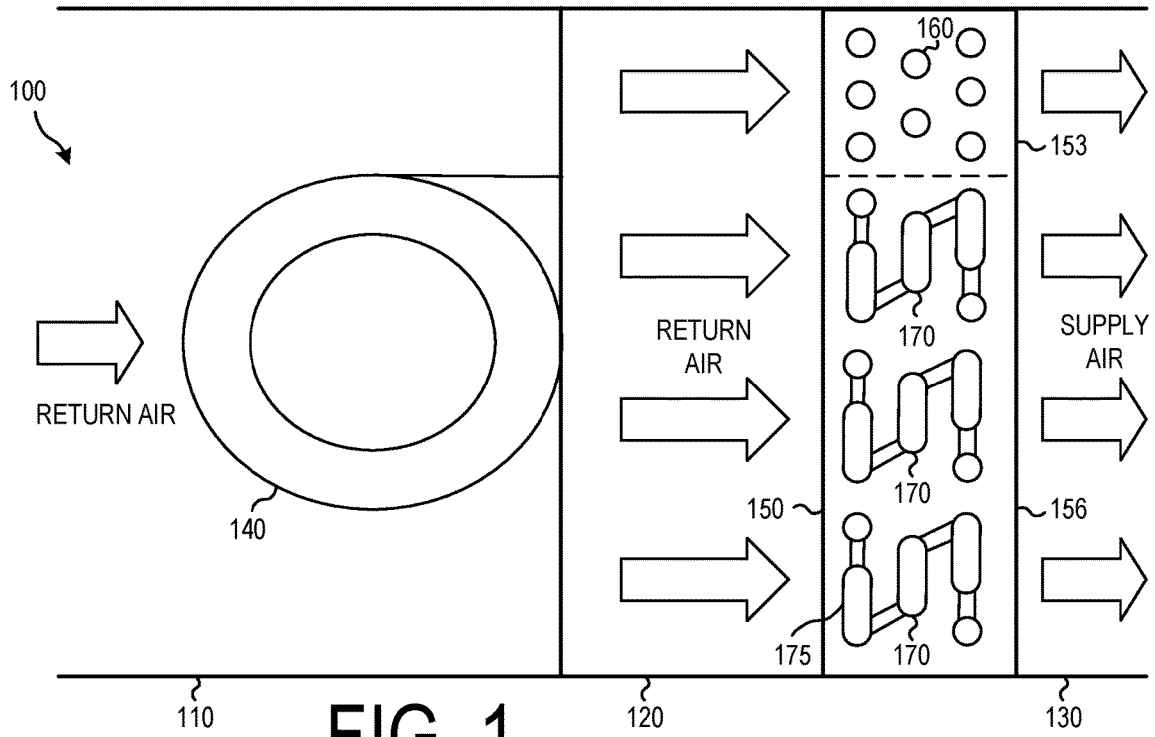
FIG. 1 is a block diagram of an indoor air-conditioning unit having an air-conditioner coil with an active portion and an inactive portion according to disclosed embodiments.

Indoor Air-Conditioning Unit Having an Air-Conditioner Coil with an Active Portion and an Inactive Portion FIG. 1 is a block diagram of an indoor air-conditioning unit 100 having an air-conditioner coil 150 with an active portion 156 and an inactive portion 153 according to disclosed embodiments.

As shown in FIG. 1, the indoor air-conditioning unit 100 includes an input vent 110, an intermediate vent 120, an output vent 130, a blower fan 140, and an air-conditioning coil 150. The air-conditioning coil 150 is divided into an inactive portion 153 and an active portion 156. The air-conditioning coil 150 includes a plurality of air conditioning tubes 160 and a plurality of U-bends 170 that connect selected refrigerant tubes 160.

The input vent 110 is an air vent that draws in return air from the zone that the air-conditioning unit 100 services. It is located upstream from the air-conditioning coil 150 in the path of airflow through the air-conditioning unit 100 and contains the blower fan 140.

The intermediate vent 120 is located between the blower fan 140 and the air-conditioning coil 150. It receives the return air drawn from the input vent 110 and channels the return air to the air-conditioning coil 150. In some embodiments the intermediate vent 120 can be a separate element from the input vent 110. In other embodiments the intermediate vent 120 and the input vent 110 can be parts of the same element with the difference between the two being defined by the placement of the blower fan 140.

The output vent 130 is located downstream from the air-conditioning coil 150 in the path of airflow through the air-conditioning unit 100. It receives conditioned and unconditioned air from the air-conditioning coil 150 that it provides to the zone assigned to the air-conditioning unit 100 as supply air. The output vent 130 can also be called an exhaust vent.

The blower fan 140 draws in the return air from the input vent 110 so that it can be provided to the air-conditioning coil 150 with sufficient force to pass through the air-conditioning coil 150. In various embodiments, the blower fan 140 can be a forward curved blower, a backward curved blower, a prop fan or linear flow blower, or any suitable blower fan.

Furthermore, although the disclosed embodiments show the blower fan 140 being upstream of the air-conditioning coil 150, this is by way of example only. Alternate embodiments can place the blower fan downstream of the air-conditioning coil 150 and use it to draw air through the air-conditioning coil 150.

The air-conditioning coil 150 is divided into an inactive portion 153 and an active portion 156. It receives the return air from the intermediate vent 120, passes a first portion of the return air through the active portion 156, and passes a second portion of the return air through the inactive portion 153.

The first portion of the return air passes through the active portion 156, which conditions the first portion of the return air, as required by the current operating mode of the air-conditioning unit 100 and provides the conditioned air at an output of the air-conditioning coil 150. Specifically, the active portion 156 operates either to heat the first portion of the return air when in a heating mode, or to cool the first portion of the return air when in a cooling mode. It does this by exchanging heat between a refrigerant passing through refrigerant tubes 160 in the active portion 156 and the first portion of the return air flowing through the active portion 156.

The second portion of the return air passes through the inactive portion 153 without conditioning and is provided as unconditioned air at the output of the air-conditioning coil 150.

The inactive portion 153 contains a plurality of refrigerant tubes 160 and may appear similar to the active portion 156 save that its refrigerant tubes 160 are not configured to circulate refrigerant. Alternate embodiments can eliminate the refrigerant tubes 160 if desired. Furthermore, alternate embodiments can include a plurality of metal fins to direct the second portion of the return air that passes through the inactive portion 153.

The inactive portion 153 is configured such that it will pass the second portion of the return air without conditioning it, thus generating unconditioned air at an output of the air-conditioning coil 150. This can be achieved by disconnecting refrigerant tubes 160 located in the inactive portion 153 from a refrigerant supply, disabling refrigerant in the refrigerant tubes 160 in the inactive portion 153 from circulating, removing the refrigerant tubes 160 from the inactive portion 153 altogether.

In the embodiment disclosed in FIG. 1, the refrigerant tubes 160 in the inactive portion 153 are not connected to a refrigerant supply and are not connected to each other via U-bends 170. However, this is by way of example only. Alternate embodiments can render the inactive portion 153 inactive through other means.

The active portion 156 contains a plurality of refrigerant tubes 160 connected together into one or more coil circuits 175 via a plurality of U-bends 170. The coil circuits 175 are arranged to circulate refrigerant to facilitate heat exchange between the refrigerant and the first portion of the return air. Alternate embodiments may include a plurality of metal fins to both direct the first portion of the return air that passes through the active portion 156 and to enhance the transfer of heat between the first portion of the return air and the refrigerant circulating through the coil circuits 175.

The active portion 156 is configured such that it will pass the first portion of the return air through it and will condition the first portion of the return air as it passes through the active portion 156 to generate conditioned air at the output of the air-conditioning coil 150. In other words, the active portion 156 will heat or cool the portion of the return air passing through it as required by the current mode of the air-conditioning unit 100.

In the embodiment of FIG. 1, the active portion 156 passes refrigerant through the refrigerant tubes 160 and the associated U-bends 170. This refrigerant will be either hotter or colder than the return air, depending upon the mode of the air-conditioning unit 100. The return air will exchange heat with the refrigerant flowing through the refrigerant tubes 160 as the return air passes through the active portion 156, thus generating conditioned air at the output of the air-conditioning coil 150.

In the embodiment of FIG. 1, unconditioned air output from the inactive portion 153 and conditioned air from the active portion 156 combine in the output vent 130 to form supply air. The conditioned and unconditioned air can mix together as they are blown out from the air-conditioning coil 150, or they can remain relatively separate airflows as they pass out of the output vent 130 into the designated zone, depending upon the particular design of the output vent 130. Alternate embodiments can employ an air mixer to facilitate the mixing of the conditioned and unconditioned air. However, such an air mixer is not required.

The refrigerant tubes 160 are tubes configured to pass refrigerant through portions of the air-conditioning portal 150. The refrigerant tubes 160 have their size and location set such that they can efficiently exchange heat with return air passing through the air-conditioning coil. The refrigerant tubes 160 in the active portion 156 are connected to a refrigerant source, while the refrigerant tubes 160 in the inactive portion 153 are not connected to the refrigerant source. In some embodiments the refrigerant tubes 160 may be connected to metal fins to enhance the ability of the refrigerant tubes 160 to exchange heat between the first portion of the return air and the refrigerant.

The plurality of U-bends 170 are U-shaped tubes that connect selected pairs of refrigerant tubes 160 in the active portion 156. Specifically, a particular U-bend 170 is connected between two refrigerant tubes 160 and serves as a conduit for refrigerant passing from one refrigerant tube 160 to the other refrigerant tube 160. By connecting pairs of refrigerant tubes 160 in the active portion 156 with U-bends 170, it is possible to create a longer conduit for refrigerant in the air-conditioning coil 150. This can reduce the number of refrigerant inputs and refrigerant outputs for the air-conditioning coil 150, thus reducing the size and manufacturing cost of the air-conditioning coil.

In many embodiments, the air-conditioning coil 150 is configured such that the refrigerant tubes 160 in the active portion 156 are connected together into two or more coil circuits coil circuits 175. For example, in the disclosed embodiment the refrigerant tubes 160 in the active portion 156 are connected together into three separate coil circuits. Each coil circuit 175 includes a plurality of refrigerant tubes 160 connected together with a corresponding plurality of U-bends 170.

Each separate coil circuit 175 circulates refrigerant independently from the other coil circuits 175. The number of coil circuits 175 is typically determined by a desire for equal refrigerant distribution and for controlling an amount of refrigerant pressure drop within the coil circuits 175.

In some embodiments, the inactive portion 153 can be created by selecting one or more sets of refrigerant tubes 160 that are configured to make one or more coil circuits 175 and failing to connect the refrigerant tubes 160 to each other via a plurality of U-bends 170 and/or failing to connect the refrigerant tubes 160 to a refrigerant source.

In the disclosed embodiments, the individual coil circuits 175 forming the active portion 156 are the same size. In other words, in these embodiments, the coil circuits 175 in the active portion 156 contain the same number of refrigerant tubes 160. Furthermore, the inactive portion 153 includes the same number of refrigerant tubes 160 used for each coil circuit 175. However, this is by way of example only. Alternate embodiments can vary the sizes of the active portion 156 and the inactive portion 153 as desired.

For example, in one embodiment a 6000 btuh air-conditioning coil could include three separate coil circuits 175 in an active portion 156. These three coil circuits 175 that form the active portion 156 would each have sufficient refrigerant tubes 160 to accommodate 2000 btuh. The inactive portion 153 could have the same number of air-conditioning coils 160 as would be required to accommodate 2000 btuh, although these air-conditioning coils 160 would not pass refrigerant. In this way, the size of the air-conditioning coil 150 would be the same as for a conventional 8000 btuh air-conditioning coil. This would allow the 6000 btuh coil to replace an 8000 btuh air-conditioning coil in any existing air-conditioning unit.

In operation, the air-conditioning coil 150 in the air-conditioning unit 100 can maintain a capacity sufficiently high to remove moisture from the first portion of the return air passing through it. However, since the active portion 156 of the air-conditioning coil 150 only conditions a first portion of the total return air, the effective capacity of the air-conditioning coil 150 will be diluted in accordance with the percentage of the total return air represented by the first portion of the return air. In other words, since the first portion 156 of the air-conditioning coil 150 only conditions a first portion of the return air, the effective capacity of the air-conditioning coil 150, and therefore of the air-conditioning unit 100, will be smaller than the capacity of the first portion 156 of the air-conditioning coil 150 alone, and can be set to be appropriate for the expected load of the assigned zone.

Furthermore, since a second portion of the return air passes through the inactive portion 153 of the air-conditioning coil 150 as unconditioned air, the total airflow through the entire air-conditioning coil 150, and therefore through the entire air-conditioning unit 100, will be higher than the airflow through the active portion 156 of the air-conditioning coil 150 alone. As a result, the airflow through the air-conditioning unit 100 can be maintained at a sufficiently high level that enough air can be blown through the air-conditioning unit 100 to service a relatively large air-conditioning zone.

In this way, the air-conditioning unit 100 can service a relatively low-load, high-volume zone while both maintaining sufficient capacity to remove moisture from the air, and simultaneously providing sufficient supply airflow to the entire zone. Although the air-active portion 156 of the conditioning coil 150 will only operate to remove moisture from the first portion of the return air, this will still continually reduce the moisture in the supply air, operating to dehumidify the air in the designated zone over time.

The size of the inactive portion 153 and the active portion 156 can be selected to achieve a desired air-conditioner capacity and a desired airflow, while maintaining the air-conditioning unit's latent capacity.

Figure 2:
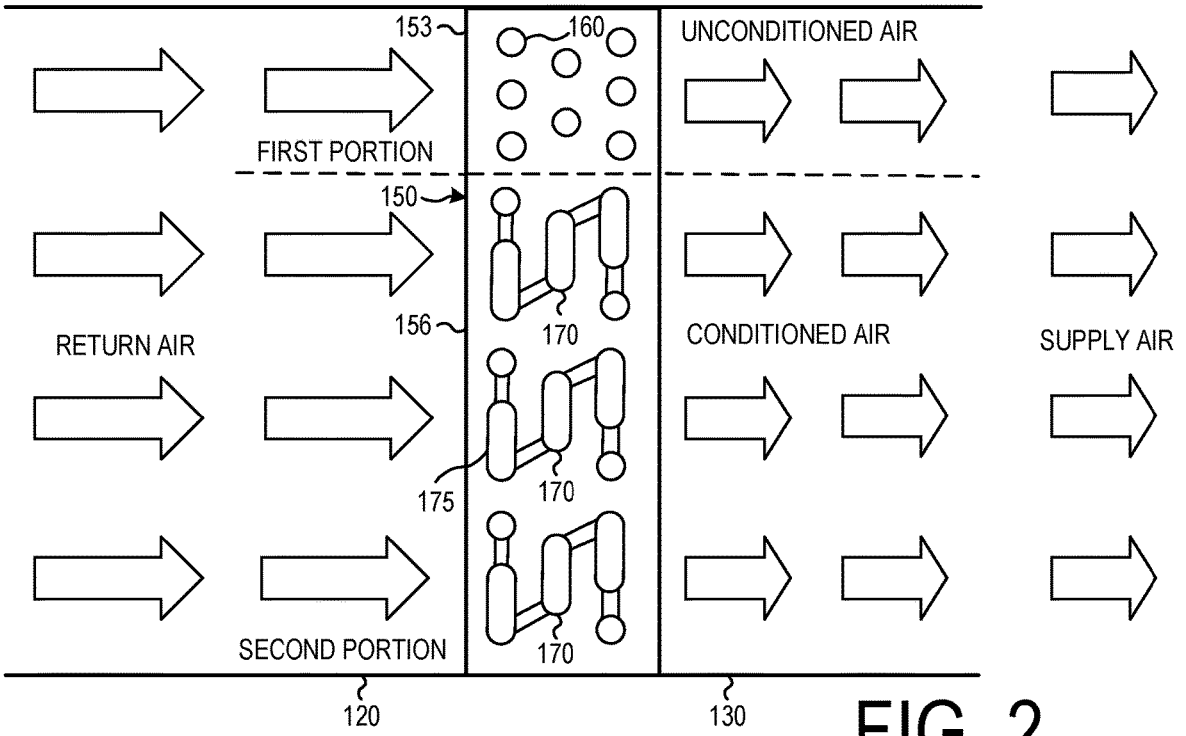
FIG. 2 is a side view of a portion of the indoor air-conditioning unit of FIG. 1 showing airflow according to disclosed embodiments.

FIG. 2 is a side view of a portion of the indoor air-conditioning unit 100 of FIG. 1 showing airflow according to disclosed embodiments. FIG. 2 shows an intermediate vent 120, an output vent 130, and an air-conditioning coil 150. The air-conditioning coil 150 is divided into an inactive portion 153 and an active portion 156. The air-conditioning coil 150 includes a plurality of air conditioning tubes 160 and a plurality of U-bends 170 that connect selected refrigerant tubes 160.

In this embodiment, the intermediate vent 120, the output vent 130, the air-conditioning coil 150, the inactive portion 153, the active portion 156, the plurality of air conditioning tubes 160, and the plurality of U-bends 170 operate as described above with respect to FIG. 1.

As shown in FIG. 2 the active portion 156 conditions the first portion of the return air to pass it as conditioned air at the output of the air-conditioning coil 150. In contrast, the inactive portion 153 passes the second portion of the return air unchanged as unconditioned air at the foot of the air-conditioning coil 150.

The unconditioned air and the conditioned air together form the supply air provided to a designated zone at the output of the output vent 130. Although this means that the output supply air may include separate streams of conditioned and unconditioned air, this will not be a problem in many embodiments since air will generally mix as it flows.

For example, even without any active attempt to mix the conditioned and unconditioned air in the output vent 130 a certain amount of mixing will occur even before the supply air is provided to the designated zone from the output vent 130. Specifically, before being discharged into the designated zone, the conditioned and unconditioned air will mix either within ductwork for ducted air-conditioners or within a cabinet or blower inlet for non-ducted models. As a result, the supply air will have an opportunity to mix before it encounters people in the designated zone.

Figure 3:
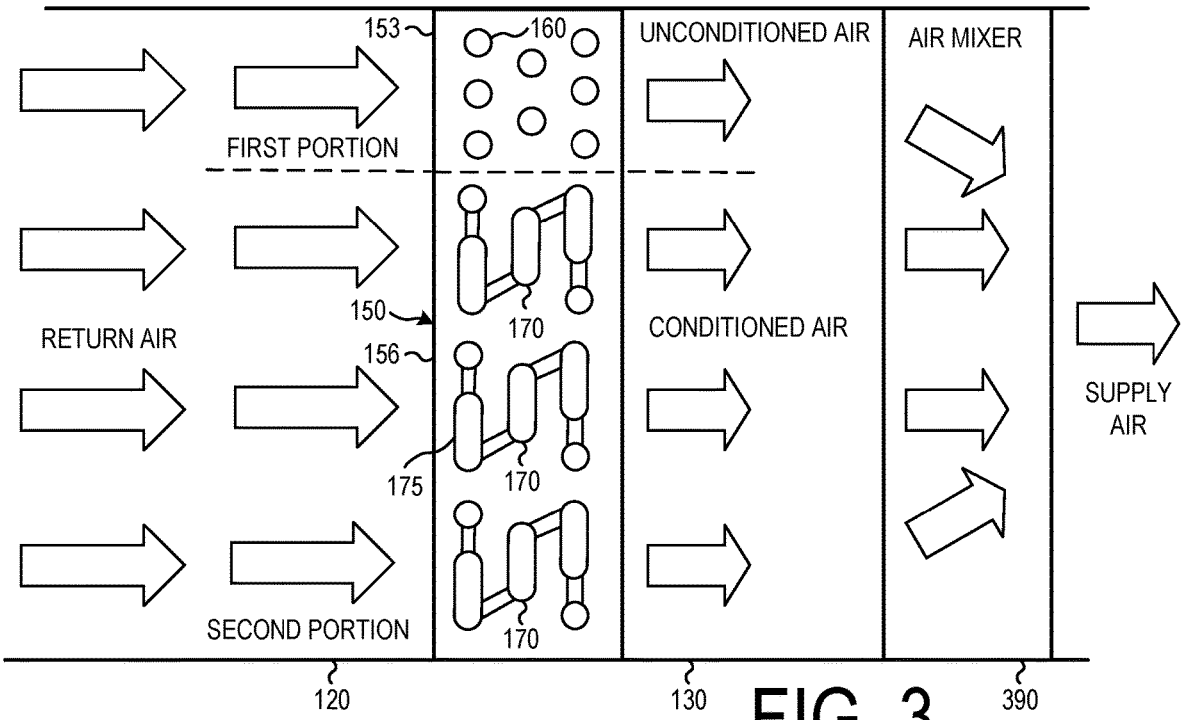
FIG. 3 is a side view of a portion of the indoor air-conditioning unit of FIG. 1 showing airflow according to alternate disclosed embodiments.

FIG. 3 is a side view of a portion of the indoor air-conditioning unit 100 of FIG. 1 showing airflow according to alternate disclosed embodiments. FIG. 3 shows an intermediate vent 120, an output vent 130, an air-conditioning coil 150, and an air mixer 390. The air-conditioning coil 150 is divided into an inactive portion 153 and an active portion 156. The air-conditioning coil 150 includes a plurality of air conditioning tubes 160 and a plurality of U-bends 170 that connect selected refrigerant tubes 160.

In this embodiment, the intermediate vent 120, the output vent 130, the air-conditioning coil 150, the inactive portion 153, the active portion 156, the plurality of air conditioning tubes 160, and the plurality of U-bends 170 operate as described above with respect to FIG. 1.

As shown in FIG. 3, the inactive portion 153 of the air-conditioning coil 150 passes the return air unchanged as unconditioned air. In contrast, the active portion 156 of the air-conditioning coil 150 conditions the return air as it passes through the act portion 156 such that the active portion 156 outputs conditioned air into the output vent 130.

In this embodiment, the air mixer 390 is provided at one end of the output vent 130 or within the output vent 130 and operates to mix the unconditioned air and the conditioned air before they are provided as the supply air. In various embodiments, the air mixer could be one or more fins or baffles used to direct the unconditioned air and conditioned air together such that they mix together. Alternate air mixers 390 can be used in alternate embodiments.

By having an air mixer 390, the air-conditioning unit 100 can more quickly provide air of a more uniform temperature and humidity at its output.

Indoor Air-Conditioning Unit Having an Air-Conditioner Coil and a Bypass Vent

Figure 4:
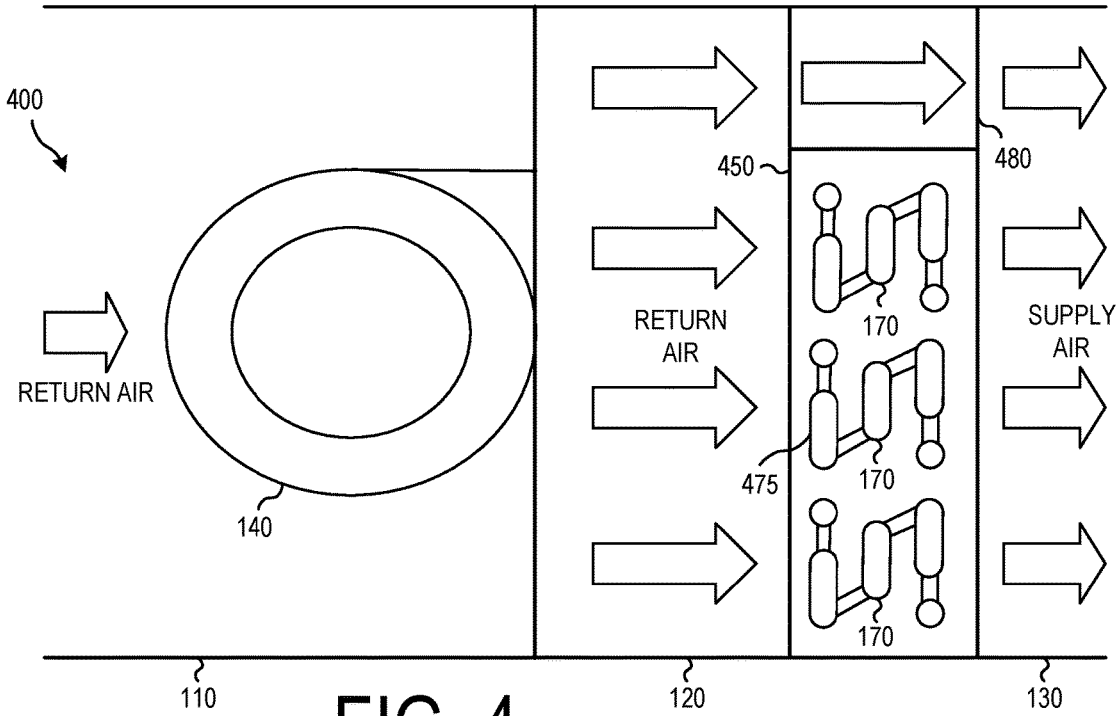
FIG. 4 is a block diagram of an indoor air-conditioning unit having an air-conditioner coil and a bypass vent according to disclosed embodiments.

FIG. 4 is a block diagram of an indoor air-conditioning unit 400 having an air-conditioner coil 450 and a bypass vent 480 according to disclosed embodiments.

As shown in FIG. 4, the indoor air-conditioning unit 400 includes an input vent 110, an intermediate vent 120, an output vent 130, a blower fan 140, an air-conditioning coil 450, and a bypass vent 480. The air-conditioning coil 450 includes a plurality of air conditioning tubes 160 and a plurality of U-bends 170 that connect selected refrigerant tubes 160.

The input vent 110 is an air vent that draws in return air from the zone in which the air-conditioning unit 400 is located. It is located upstream from the air-conditioning coil 450 and the bypass vent 480 in the path of airflow through the air-conditioning unit 100 and contains the blower fan 140.

The intermediate vent 120 is located between the blower fan 140 and both the air-conditioning coil 450 and the bypass vent 480. It receives the return air drawn from the input vent 110 and channels the return air to the air-conditioning coil 450 and the bypass vent 480. In some embodiments the intermediate vent 120 can be a separate element from the input vent 110. In other embodiments the intermediate vent 120 and the input vent 110 can be parts of the same element with the difference between the two being defined by the placement of the blower fan 140.

The output vent 130 is located downstream from the air-conditioning coil 450 and the bypass vent 480 in the path of airflow through the air-conditioning unit 100. It receives conditioned air from the air-conditioning coil 150 and unconditioned air from the bypass vent 480 that it collectively provides to the zone assigned to the air-conditioning unit 100 as supply air.

The blower fan 140 draws in the return air from the input vent 110 so that it can be provided to the air-conditioning coil 450 and the bypass vent 480 with sufficient force to pass through the air-conditioning coil 450 and the bypass vent 480. In various embodiments, the blower fan 140 can be a forward curved blower, a backward curved blower, a prop fan or linear flow blower, or any suitable blower fan.

The blower fan 140 draws in the return air from the input vent 110 so that it can be provided to the air-conditioning coil 150 with sufficient force to pass through the air-conditioning coil 150. In various embodiments, the blower fan 140 can be a forward curved blower, a backward curved blower, a prop fan or linear flow blower, or any suitable blower fan.

Furthermore, although the disclosed embodiments show the blower fan 140 being upstream of the air-conditioning coil 450, this is by way of example only. Alternate embodiments can place the blower fan downstream of the air-conditioning coil 450 and use it to draw air through the air-conditioning coil 450.

The air-conditioning coil 450 includes a plurality of refrigerant tubes 160 connected together into one or more coil circuits 175 via a plurality of U-bends 170. The coil circuits 175 are arranged to circulate refrigerant to facilitate heat exchange between the refrigerant and the first portion of the return air. Alternate embodiments may include a plurality of metal fins to both direct the first portion of the return air that passes through the air-conditioning coil 450 and to enhance the transfer of heat between the first portion of the return air and the refrigerant circulating through the coil circuits 175.

The air-conditioning coil 450 receives a first portion of the return air. It operates to condition the first portion of the return air, as required by the current settings of the air-conditioning unit 400 and provides the conditioned air at an output of the air-conditioning coil 450. Specifically, the air-conditioning coil 450 operates either to heat the first portion of the return air when the air-conditioning unit 400 is in a heating mode, or to cool the first portion of the return air when the air-conditioning unit 400 is in a cooling mode. It does this by exchanging heat between a refrigerant passing through refrigerant tubes 160 in the air-conditioning coil 450 and the first portion of the return air flowing through the air-conditioning coil 450. The conditioning may also involve dehumidifying the first portion of the return air.

The bypass vent 480 is an air vent that passes a second portion of the return air without conditioning it, thus generating unconditioned air at an output of the bypass vent 480.

The conditioned air output from the air-conditioning coil 450 and the unconditioned air output from the bypass vent 480 combine in the output vent 130 into supply air. The conditioned and unconditioned air can mix together as they are blown out from the air-conditioning coil 450, and the bypass vent 480 or they can remain relatively separate airflows as they pass out of the output vent 130 into the designated zone, depending upon the particular design of the output vent 130. Alternate embodiments can employ an air mixer to facilitate the mixing of the conditioned and unconditioned air. However, such an air mixer is not required.

The refrigerant tubes 160 are tubes configured to pass refrigerant through portions of the air-conditioning coil 450. The refrigerant tubes 160 have their size and location set such that they can efficiently exchange heat with return air passing through the air-conditioning coil 450. The refrigerant tubes 160 in the air-conditioning coil 450 are connected to a refrigerant source.

The plurality of U-bends 170 are U-shaped tubes that connect selected pairs of refrigerant tubes 160 in the air-conditioning coil 450. Specifically, each U-bend 170 is connected between two corresponding refrigerant tubes 160 and serves to pass refrigerant from one refrigerant tube 160 to the other refrigerant tube 160. By connecting pairs of refrigerant tubes 160 in the air-conditioning coil 450 with U-bends 170, it is possible to create one or more coil circuits 475 for circulating the refrigerant through the air-conditioning coil 450. This can reduce the number of refrigerant inputs and refrigerant outputs for the air-conditioning coil 450, thus reducing the size and manufacturing cost of the air-conditioning coil 450.

In some embodiments the refrigerant tubes 160 may also be connected to metal fins to enhance the transfer of heat between the first portion of the return air and the refrigerant in the coil circuits 475.

In many embodiments, the air-conditioning coil 450 is configured such that the refrigerant tubes 160 are connected together into two or more coil circuits 475. For example, in the disclosed embodiment the refrigerant tubes 160 in the air-conditioning coil 450 are connected together into three separate coil circuits 475. Each coil circuit 475 includes a plurality of refrigerant tubes 160 connected together with a corresponding plurality of U-bends 170.

Each separate coil circuit 475 circulates refrigerant independently from the other coil circuits 475. The number of coil circuits 175 is typically determined by a desire for equal refrigerant distribution and for controlling an amount of refrigerant pressure drop within the coil circuits 175.

In various embodiments, the individual coil circuits 475 forming the air-conditioning coil 450 are the same size. In other words, in these embodiments, the coil circuits 475 in the air-conditioning coil 450 contain the same number of refrigerant tubes 160. Furthermore, the bypass vent 480 can be selected to be the same size as one or more of the coil circuits 475.

For example, in one embodiment a 6000 btuh air-conditioning coil 450 could include three separate coil circuits 475. These three coil circuits 475 would each have sufficient refrigerant tubes 160 to accommodate 2000 btuh, or ¼ of the cubic feet per minute (CFM) of the return air processed by the air-conditioning unit 400 for each of the three coil circuits 475. Similarly, the bypass vent 480 could be sized to pass ¼ the CFM of the return air processed by the air-conditioning unit 400. In this way, the size of the combination of the air-conditioning coil 450 and the bypass vent 480 would result in a combined element having the same size as a conventional 8000 btuh air-conditioning coil. This would allow the combination of the disclosed air-conditioning coil 450 and bypass vent 480 to replace an 8000 btuh air-conditioning coil in any existing device.

In operation, the air-conditioning coil 450 in the air-conditioning unit 400 can maintain a capacity sufficiently high to remove moisture from the first portion of the return air passing through it. However, since the air-conditioning coil 450 only conditions a first portion of the total return air, the effective capacity of the air-conditioning unit 400 will be diluted in accordance with the percentage of the total return air represented by the first portion of the return air. In other words, since the air-conditioning coil 450 only conditions a first portion of the return air, the effective capacity of the air-conditioning unit 400 will be smaller than the capacity of the air-conditioning coil 450 alone and can be set to be appropriate for the expected load of the assigned zone.

Furthermore, since a second portion of the return air passes through the bypass vent 480 as unconditioned air, the total airflow through the entire air-conditioning unit 400 will be higher than the airflow of the air-conditioning coil 450 alone. As a result, the airflow through the air-conditioning unit 400 can be maintained at a sufficiently high level that enough air can be blown through the air-conditioning unit 400 to service a relatively large air-conditioning zone.

If in this way, the air-conditioning unit 400 can service a relatively low-load, high-volume zone while both maintaining sufficient capacity to remove moisture from the air, and simultaneously providing sufficient supply airflow to the entire zone. Although the air-conditioning coil 450 will only operate to remove moisture from the first portion of the return air, this will still continually reduce the moisture in the supply air, operating to dehumidify the air in the designated zone over time.

The size of the air-conditioning coil 450 and the bypass vent 480 can be set to achieve a desired air-conditioning capacity and airflow while maintaining a desired latent capacity.

Figure 5:
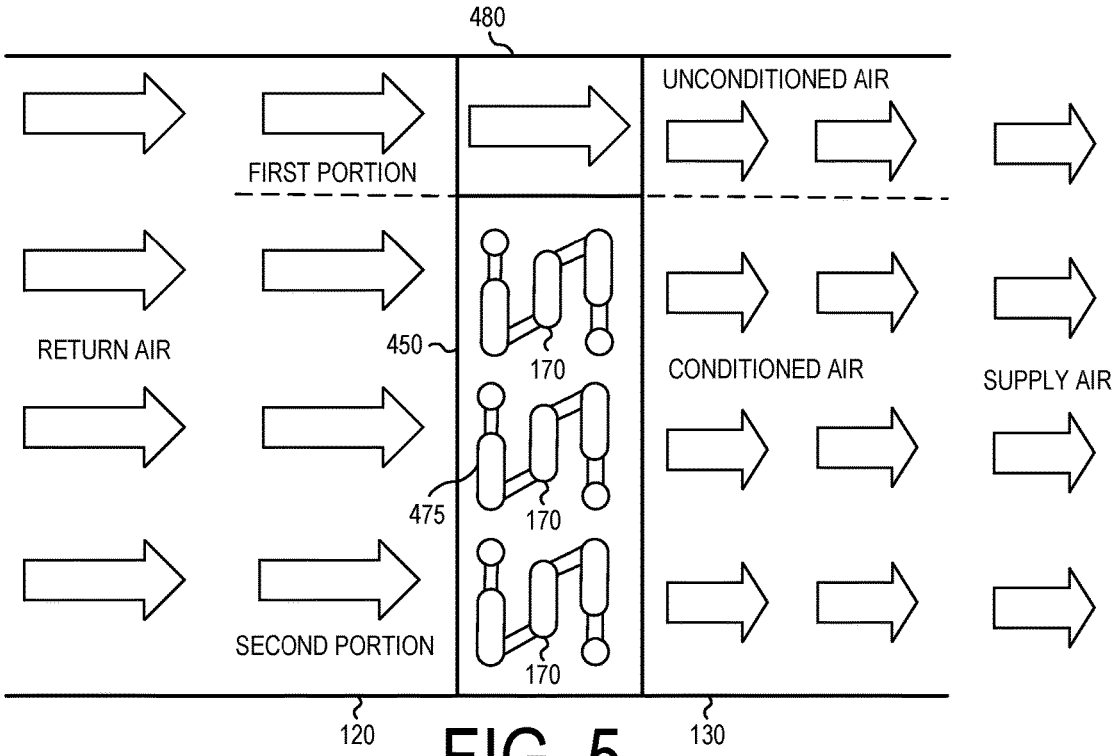
FIG. 5 is a side view of a portion of the indoor air-conditioning unit of FIG. 4 showing airflow according to disclosed embodiments.

FIG. 5 is a side view of a portion of the indoor air-conditioning unit 400 of FIG. 4 showing airflow according to disclosed embodiments. FIG. 5 shows an intermediate vent 120, an output vent 130, an air-conditioning coil 450, and a bypass vent 480. The air-conditioning coil 450 includes a plurality of air conditioning tubes 160 and a plurality of U-bends 170 that connect selected refrigerant tubes 160.

In this embodiment, the intermediate vent 120, the output vent 130, the air-conditioning coil 450, the bypass vent 480, the plurality of air conditioning tubes 160, and the plurality of U-bends 170 operate as described above with respect to FIGS. 1 and 4.

As shown in FIG. 5, the air-conditioning coil 450 conditions the first portion of the return air to pass it as conditioned air at the output of the air-conditioning coil 450. Likewise, the bypass vent 480 passes the second portion of the return air unchanged as unconditioned air at the output of the bypass vent 480.

The unconditioned air and the conditioned air together form the supply air provided to a designated zone at the output of the output vent 130. Although this means that the output supply air may include separate streams of conditioned and unconditioned air, this will not be a problem in many embodiments since air will generally mix as it flows.

For example, even without any active attempt to mix the conditioned and unconditioned air in the output vent 130 a certain amount of mixing will occur even before the supply air is provided to the designated zone from the output vent 130. Specifically, before being discharged into the designated zone, the conditioned and unconditioned air will mix either within ductwork for ducted air-conditioners or within a cabinet or blower inlet for non-ducted models. As a result, the supply air will have an opportunity to mix before it encounters people in the designated zone.

Figure 6:
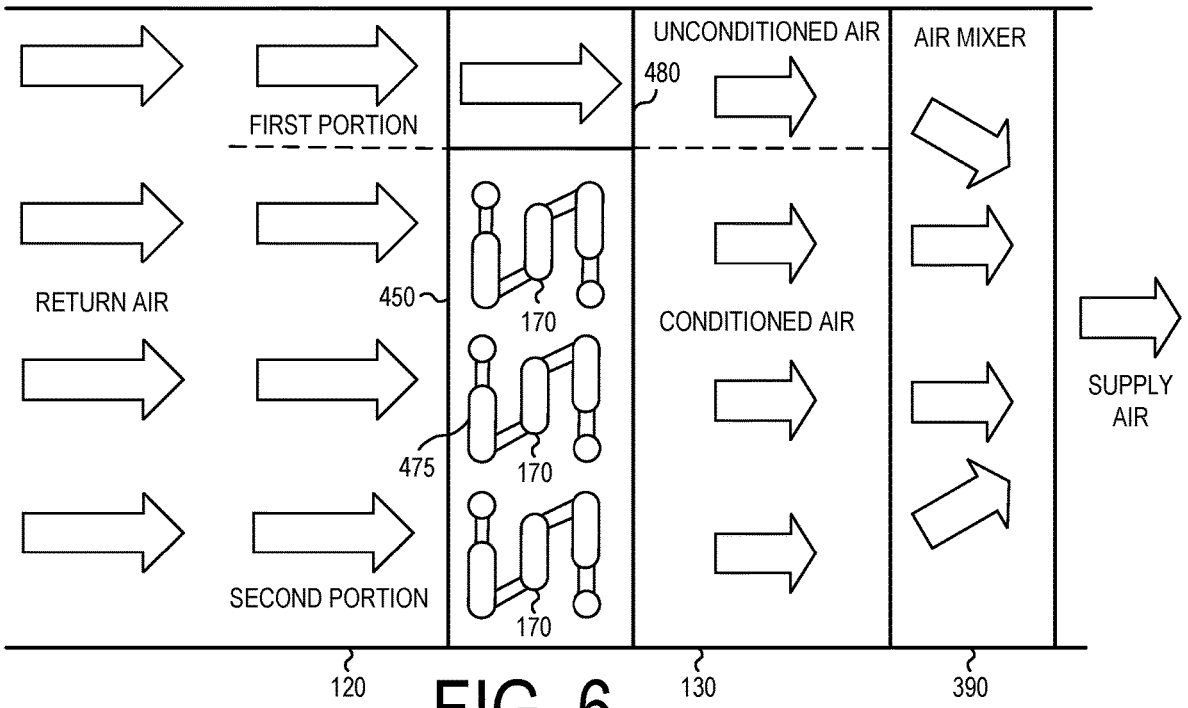
FIG. 6 is a side view of a portion of the indoor air-conditioning unit of FIG. 4 showing airflow according to alternate disclosed embodiments.

FIG. 6 is a side view of a portion of the indoor air-conditioning unit 400 of FIG. 4 showing airflow according to alternate disclosed embodiments. FIG. 6 shows an intermediate vent 120, an output vent 130, an air-conditioning coil 150, and an air mixer 390. The air-conditioning coil 450 includes a plurality of air conditioning tubes 160 and a plurality of U-bends 170 that connect selected refrigerant tubes 160.

In this embodiment, the intermediate vent 120, the output vent 130, the air-conditioning coil 450, the bypass vent 480, the plurality of air conditioning tubes 160, the plurality of U-bends 170, and the air mixer 390 operate as described above with respect to FIGS. 1, 3, and 4.

As shown in FIG. 6, the air-conditioning coil 450 conditions the first portion of the return air as it passes through the air-conditioning coil 450 such that the air-conditioning coil 450 outputs conditioned air into the output vent 130. In contrast, the bypass vent 480 passes the second portion of the return air unchanged to the output vent 130 as unconditioned air.

As noted above, the air mixer 390 is provided at one end of the output vent 130 or within the output vent 130 and operates to mix the unconditioned air and the conditioned air before they are provided as the supply air. In various embodiments, the air mixer could be one or more fins or baffles used to direct the unconditioned air and conditioned air together such that they mix together. Alternate air mixers 390 can be used in alternate embodiments.

By having an air mixer 390, the air-conditioning unit 400 can more quickly provide supply air of a uniform temperature at its output.

Figure 7:
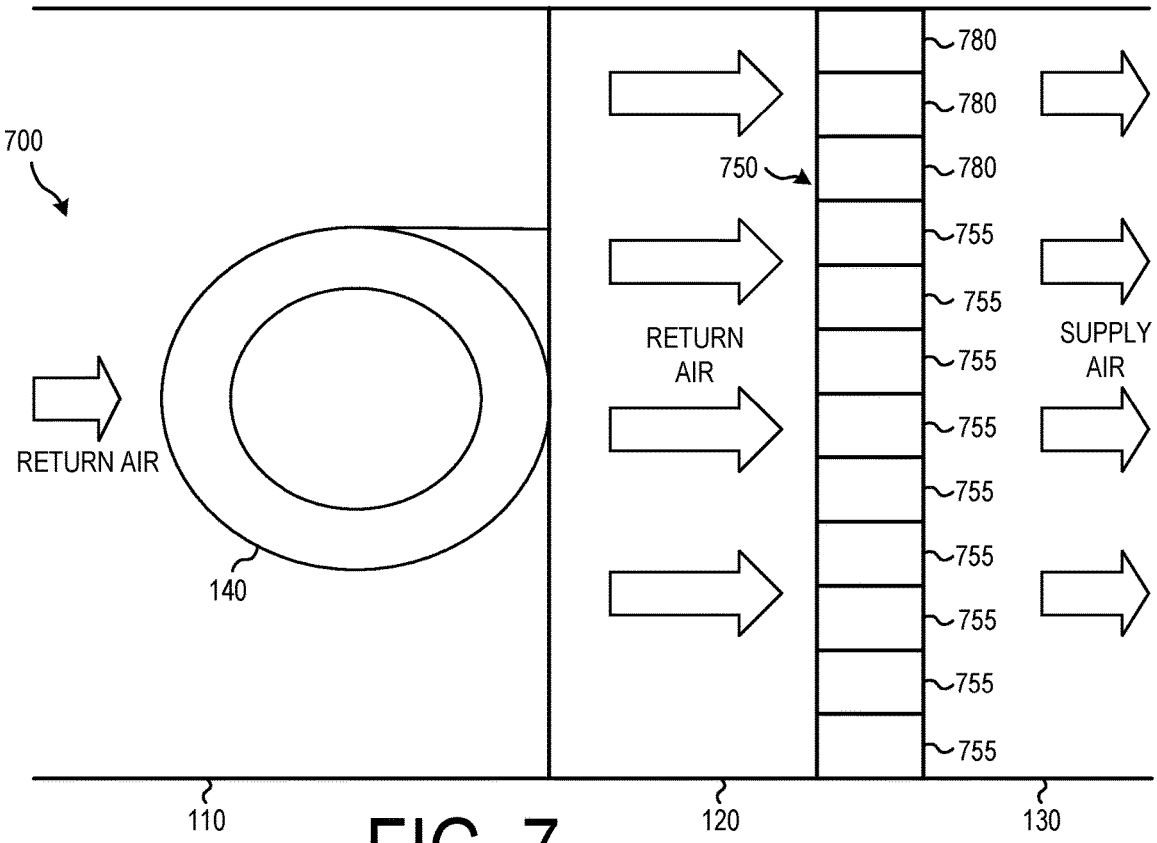
FIG. 7 is a block diagram of an indoor air-conditioning unit having an air-conditioner coil having a plurality of active segments and a plurality of inactive segments according to disclosed embodiments.

Indoor Air-Conditioning Unit Having an Air-Conditioner Coil with a Plurality of Active Portions and a Plurality of Inactive Portions FIG. 7 is a block diagram of an indoor air-conditioning unit 700 having an air-conditioner coil 750 having a plurality of active segments 755 and a plurality of inactive segments 780 according to disclosed embodiments.

As shown in FIG. 7, the indoor air-conditioning unit 700 includes an input vent 110, an intermediate vent 120, an output vent 130, a blower fan 140, and an air-conditioning coil 750. The air-conditioning coil 750 is divided into a plurality of active portions 755 and a plurality of inactive portions 780.

The input vent 110 is an air vent that draws in return air from the zone in which the air-conditioning unit 700 is located. It is located upstream from the air-conditioning coil 750 in the path of airflow through the air-conditioning unit 700 and contains the blower fan 140.

The intermediate vent 120 is located between the blower fan 140 and the air-conditioning coil 750. It receives the return air drawn from the input vent 110 and channels the return air to the air-conditioning coil 750. In some embodiments the intermediate vent 120 can be a separate element from the input vent 110. In other embodiments the intermediate vent 120 and the input vent 110 can be parts of the same element with the difference between the two being defined by the placement of the blower fan 140.

The output vent 130 is located downstream from the air-conditioning coil 750 in the path of airflow through the air-conditioning unit 700. It receives conditioned and unconditioned air from the air-conditioning coil 750 that it provides to the zone assigned to the air-conditioning unit 700 as supply air.

The blower fan 140 draws in the return air from the input vent 110 so that it can be provided to the air-conditioning coil 750 with sufficient force to pass through the air-conditioning coil 750. In various embodiments, the blower fan 140 can be a forward curved blower, a backward curved blower, a prop fan or linear flow blower, or any suitable blower fan.

Furthermore, although the disclosed embodiments show the blower fan 140 being upstream of the air-conditioning coil 750, this is by way of example only. Alternate embodiments can place the blower fan downstream of the air-conditioning coil 450 and use it to draw air through the air-conditioning coil 750.

The air-conditioning coil 750 is divided into a plurality of active portions 755 and a plurality of inactive portions 780. It receives the return air from the intermediate vent 120, passes a first portion of the return air through the plurality of active portions 755, and passes a second portion of the return air through the plurality of inactive portions 780.

The plurality of active portions 755 are arranged to collectively pass the first portion of the return air from the intermediate vent 120 to the output vent 130. The plurality of active portions 755 are also arranged to collectively condition the first portion of the return air as it passes through the plurality of active portions 755 to generate conditioned air at the outputs of the plurality of active portions 755. This conditioning will be either heating or cooling, as required by the current settings of the air-conditioning unit 700. The conditioning may also include dehumidifying the air in some embodiments.

The active portions 755 perform heating or cooling by passing refrigerant through them and allowing the air passing through them to exchange heat with the refrigerant flowing through them. In some embodiments the refrigerant passes through refrigerant tubes that are formed in an air path through the active portions 755. These refrigerant tubes may be configured as the refrigerant tubes 160 from FIGS. 1-6 with associated U-bends 170 or they may be formed in a different manner.

During a heating mode the refrigerant passing through each of the active portions 755 will preferably be hotter than the return air. As a result, when the first portion of the return air passes through the active portions 755 during a heating mode, it will absorb heat from the refrigerant and the resulting conditioned air will be warmer than the return air.

Similarly, during a cooling mode the refrigerant passing through each of the active portions 755 will preferably be cooler than the return air. As a result, when the first portion of the return air passes through the active portions 755 during a cooling mode, it will dissipate heat to the refrigerant and the resulting conditioned air will be cooler than the return air.

Each individual active portion 755 represents one or more refrigerant paths through the air-conditioning coil 750. For example, in one embodiment each active portion 755 represents a single refrigerant path through the air-conditioning coil 750. In alternate embodiments multiple refrigerant paths can be contained in each active portion 755.

In the embodiment of FIG. 7, each active portion 755 is the same size. However, this is by way of example only. Alternate embodiments could use active portions 755 of different sizes.

The inactive portions 780 are configured to pass the second portion of the return air without conditioning it, thus generating unconditioned air at an output of the air-conditioning coil 750. The inactive portions 780 are preferably similar in configuration to the active portions 755, save that they cannot pass refrigerant through them. For example, if the active portions 755 include refrigerant tubes through which the refrigerant flows, the inactive portions 780 can include refrigerant tubes as well. This can allow for more efficient manufacturing of the air-conditioning coil 750 since the inactive portions 780 can be manufactured in the same or a similar manner as the active portions 755. Alternate embodiments can include metal fins to enhance the ability of the refrigerant to exchange heat with the first portion of the return air.

Preventing refrigerant from flowing through the inactive portions 780 can be achieved in various embodiments by disconnecting refrigerant tubes 160 located in the inactive portions 780 from a refrigerant supply, disabling refrigerant in the refrigerant tubes in the inactive portions 780 from circulating, or removing the refrigerant tubes 160 from the inactive portion 153 altogether. These configurations are by way of example only. Alternate embodiments can disconnect the inactive portions 780 from a refrigerant supply in alternate ways.

By having the active portions 755 and inactive portions 780 be formed in the same air-conditioning coil 750, the disclosed air-conditioning unit 700 can provide an air-conditioning coil 750 that can be used in existing air-conditioning units designed for an air-conditioning coil of a similar size to the air-conditioning coil 750 but made up of only active portions 755. This can significantly improve the backwards compatibility of the air-conditioning coil 750 with respect to existing air-conditioning units.

In the embodiment of FIG. 7, conditioned air output from the active portions 755 and unconditioned air output from the inactive portions 780 combine in the output vent 130 to form supply air. The conditioned and unconditioned air can mix together as they are blown out from the air-conditioning coil 750, or they can remain relatively separate airflows as they pass out of the output vent 130 into the designated zone, depending upon the design of the output vent 130. Alternate embodiments can employ an air mixer to facilitate the mixing of the conditioned and unconditioned air. However, such an air mixer is not required.

For example, in one embodiment a 12,000 btuh air-conditioning coil 750 could include nine active portions 755 and three inactive portions 780, all the same size. Each active portion 755 would be configured to accommodate 1000 btuh, while each inactive portion 153 could be configured to have a similar arrangement of components as one of the active portions 755, but with no ability to flow refrigerant. For example, if each active portion 755 included a single coil circuit made up of refrigerant tubes sufficient to accommodate 1000 btuh, then each inactive portion 780 might include the same number of refrigerant tubes, but without those refrigerant tubes being connected to a refrigerant source. In some embodiments, the active portions 755 and the inactive portions 780 could be identical in construction, with the determination of whether a portion is in inactive portion 755 or an active portion 780 being determined by whether the portion is connected to a refrigerant source.

In alternate embodiments the active portions 755 and the inactive portions 780 can have different configurations and sizes. In fact, in some embodiments one active portion 755 may be different from another active portion 755 and one inactive portion 780 may be different from another inactive portion 780.

In operation, the air-conditioning coil 750 in the air-conditioning unit 700 can maintain a capacity sufficiently high to remove moisture from the first portion of the return air passing through it. However, since the active portions 755 of the air-conditioning coil 750 only condition a first portion of the total return air, the effective capacity of the air-conditioning coil 750 will be diluted in accordance with the percentage of the total return air represented by the first portion of the return air. In other words, since the active portions 755 of the air-conditioning coil 750 only condition a first portion of the return air, the effective capacity of the air-conditioning coil 750, and therefore of the air-conditioning unit 700, will be smaller than the capacity of the active portions 755 of the air-conditioning coil 750 alone, and can be set to be appropriate for the expected load of the assigned zone.

Furthermore, since the second portion of the return air passes through the inactive portions 780 of the air-conditioning coil 750 as unconditioned air, the total airflow through the entire air-conditioning coil 750, and therefore through the entire air-conditioning unit 700, will be higher than the airflow through the active portions 755 of the air-conditioning coil 750 alone. As a result, the airflow through the air-conditioning unit 700 can be maintained at a sufficiently high level that enough air can be blown through the air-conditioning unit 700 to service a relatively large air-conditioning zone.

In this way, the air-conditioning unit 700 can service a relatively low-load, high-volume zone while both maintaining sufficient capacity to remove moisture from the air, and simultaneously providing sufficient supply airflow to the entire zone. Although the active portions 755 of the conditioning coil 750 will only operate to remove moisture from the first portion of the return air, this will still continually reduce the moisture in the supply air, operating to dehumidify the air in the designated zone over time.

The number and configuration of the active portions 755 and the inactive portions 780 can be set to provide a desired air-conditioning capacity and airflow while maintaining a desired latent capacity.

Furthermore, although in the embodiment of FIG. 7, all the active portions 755 are shown as being grouped together and all the inactive portions 780 are shown as being grouped together, this is by way of example only.

In addition, although in the embodiment of FIG. 7, the active portions 755 and the inactive portions 780 or all shown as being the same size, this is by way of example only. Alternate embodiments could use different sizes for the active portions 755, the inactive portions 780, or any combination of the active portion 755 and the inactive portion 780.

Figure 8:
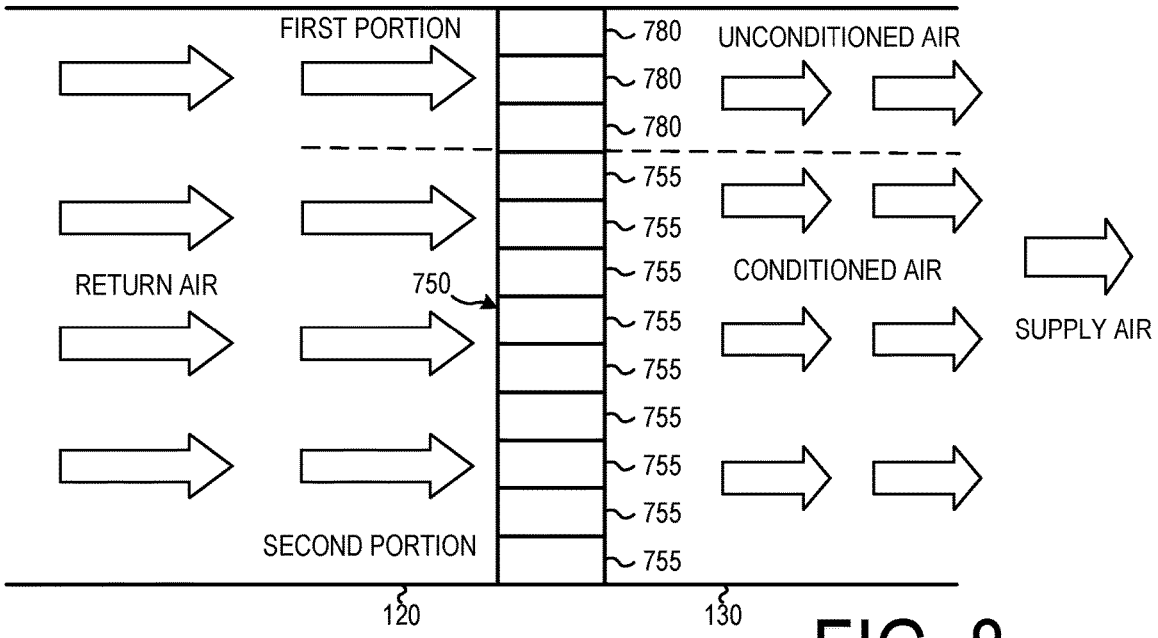
FIG. 8 is a side view of a portion of the indoor air-conditioning unit of FIG. 7 showing airflow according to disclosed embodiments.

FIG. 8 is a side view of a portion of the indoor air-conditioning unit 700 of FIG. 7 showing airflow according to disclosed embodiments. FIG. 8 shows an intermediate vent 120, an output vent 130, and an air-conditioning coil 750. The air-conditioning coil 750 is divided into a plurality of active portions 755 and a plurality of inactive portion 780.

In this embodiment, the intermediate vent 120, the output vent 130, the air-conditioning coil 750, the active portions 755, and the inactive portions 780 operate as described above with respect to FIGS. 1 and 7.

As shown in FIG. 8 the active portions 755 condition the first portion of the return air to pass it as conditioned air at the output of the air-conditioning coil 750. In contrast, the inactive portion 780 passes the second portion of the return air unchanged as unconditioned air at the output of the air-conditioning coil 750.

The unconditioned air and the conditioned air together form the supply air provided to a designated zone at the output of the output vent 130. Although this means that the output supply air may include separate streams of conditioned and unconditioned air, this will not be a problem in many embodiments since air will generally mix as it flows.

For example, even without any active attempt to mix the conditioned and unconditioned air in the output vent 130 a certain amount of mixing will occur even before the supply air is provided to the designated zone from the output vent 130. Specifically, before being discharged into the designated zone, the conditioned and unconditioned air will mix either within ductwork for ducted air-conditioners or within a cabinet or blower inlet for non-ducted models. As a result, the supply air will have an opportunity to mix before it encounters people in the designated zone.

Figure 9:
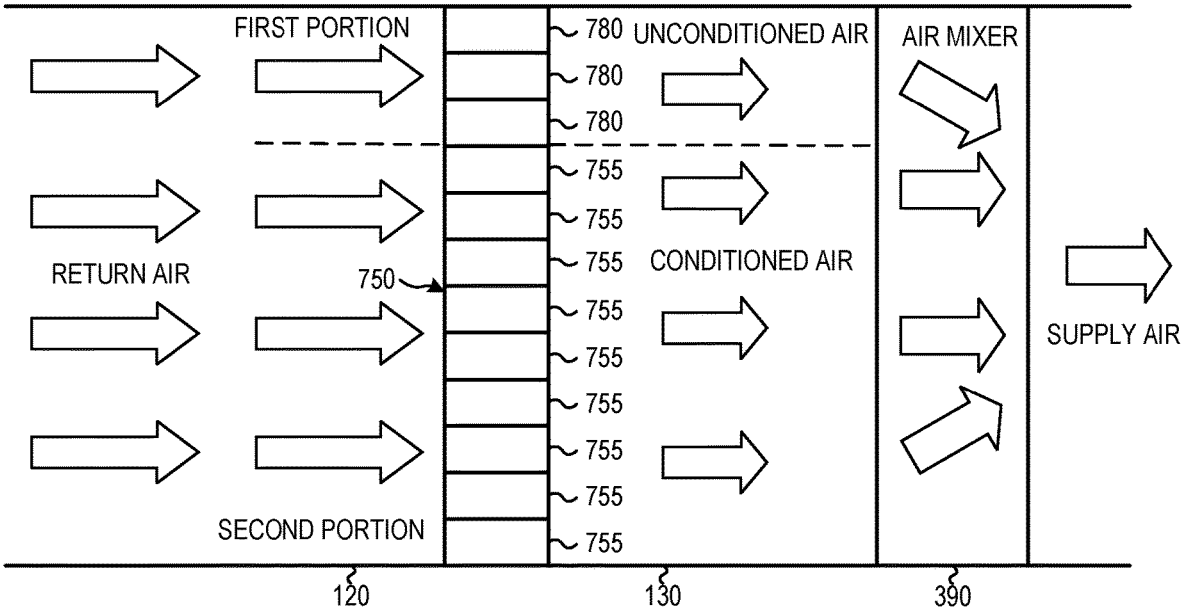
FIG. 9 is a side view of a portion of the indoor air-conditioning unit of FIG. 7 showing airflow according to alternate disclosed embodiments.

FIG. 9 is a side view of a portion of the indoor air-conditioning unit 100 of FIG. 1 showing airflow according to alternate disclosed embodiments. FIG. 9 shows an intermediate vent 120, an output vent 130, an air-conditioning coil 750, and an air mixer 390. The air-conditioning coil 750 is divided into a plurality of active portions 755 and a plurality of inactive portions 780.

In this embodiment, the intermediate vent 120, the output vent 130, the air-conditioning coil 750, the active portions 755, the inactive portions 780, and the air mixer 390 operate as described above with respect to FIGS. 1, 3, and 7.

As shown in FIG. 9, the active portions 755 of the air-conditioning coil 750 collectively condition the return air as it passes through the active portions 755 such that the active portions 755 output conditioned air into the output vent 130. In contrast, the inactive portions 780 of the air-conditioning coil 750 pass the return air unchanged as unconditioned air into the output vent 130.

In this embodiment, the air mixer 390 is provided at one end of the output vent 130 or within the output vent 130 and operates to mix the unconditioned air and the conditioned air before they are provided as the supply air. In various embodiments, the air mixer could be one or more fins or baffles used to direct the unconditioned air and conditioned air together such that they mix together. Alternate air mixers 390 can be used in alternate embodiments.

By having an air mixer 390, the air-conditioning unit 700 can more quickly provide air of a uniform temperature at its output.

Figure 10:
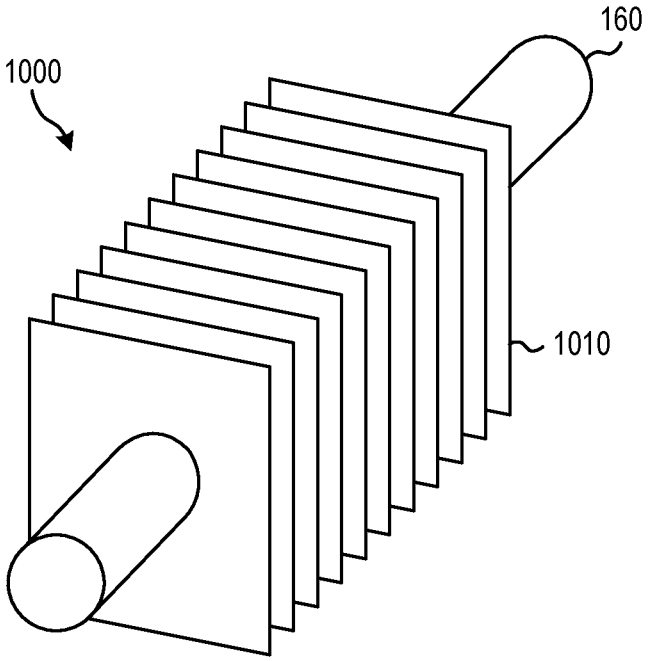
FIG. 10 is an illustration of a refrigerant tube passing through a plurality of metal fins for use in an indoor air-conditioning unit according to alternate disclosed embodiments.

Heat Conducting Fins in an Air-Conditioner Coil of an Indoor Air-Conditioning Unit FIG. 10 is an illustration 1000 of a refrigerant tube 160 passing through a plurality of metal fins 1010 for use in an indoor air-conditioning unit according to alternate disclosed embodiments.

The refrigerant tube 160 is a tube provided in an air-conditioning coil 150, 450, 750 to pass refrigerant for transferring heat with return air drawn into the air-conditioning coil 150, 450, 750.

In embodiments in which an air-conditioning coil 150, 750 has active portions 156, 755 and inactive portions 153, 780, refrigerant tubes 160 may be provided in both the active portions 156, 755 and the inactive portions 153, 780 of the air-conditioning coil 150, 750. In such embodiments, however, only the refrigerant tubes 160 provided in the active portions 156, 755 will have refrigerant flowing through them. In such cases multiple refrigerant tubes 160 can be connected together to form one or more coil circuits 175, 475 through the air-conditioning coil 150, 450, 750 for circulating the refrigerant. In contrast, the refrigerant tubes 160 in the inactive portions 153, 780 will not have refrigerant passing through them.

The metal fins 1010 are formed as a plurality of parallel metal fins 1010 that are all thermally connected to the refrigerant tubes 160 such that heat can easily be transferred between the metal fins 1010 and the refrigerant tubes 160.

Although FIG. 10 shows that each metal fin 1010 includes only one refrigerant tube 160 a metal fin 1010 may, in fact, be much larger than illustrated and may have many refrigerant tubes 160 passing through it.

The metal fins 1010 can serve two purposes. First, they are placed in a pattern to direct air through the air-conditioning coil 150, 450, 750 from the intermediate vent 120 to the output vent 130 in a way that allows the return air drawn into the air-conditioning coil 150, 450, 750 to pass over many of the metal fins 1010. Second, they facilitate the transfer of heat between the return air and the refrigerant tubes 160 when refrigerant is flowing through the refrigerant tubes 160.

In an air-conditioning coil 450 that only has active elements and in the active portions 156, 755 of an air-conditioning coil 150, 750 with both active portions 156, 755 and inactive portions 153, 780, the metal fins 1010 will conduct heat to or from the refrigerant circulating through the refrigerant tubes 160. As a result, when the refrigerant is warm, the metal fins 1010 will become warm, and when the refrigerant is cool, the metal fins 1010 will become cool. As return air passes over the metal fins 1010, heat will be transferred between the metal fins 1010 and the return air, warming or cooling the air, as appropriate. Because the metal fins 1010 have a much larger surface area over which the return air passes then do the refrigerant tubes 160, and the middle fins 1010 are arranged such that a maximum amount of the return air will pass over them, heat transfer will be more efficient between the metal fins 1010 and the return air then between the refrigerant in the refrigerant tubes 160 and the return air.

Furthermore, since the metal fins 1010 are thermally connected to the refrigerant tubes 160, heat can then be easily transferred between the metal fins 1010 and the refrigerant tubes 160. As a result, heat can effectively be transferred between the return air and the refrigerant in the refrigerant tubes 160 using the metal fins 1010 as a heat conduit.

In the inactive portions 153, 780 of an air-conditioning coil 150, 750 with both active portions 156, 755 and inactive portions 153, 780, the metal fins 1010 can still operate to conduct heat. However, with no refrigerant passing through the refrigerant tubes 160 in the inactive portions 153, 780, the metal fins 1010 will be at approximately the same temperature as the return air and no appreciable heat will be transferred between the metal fins 1010 and the return air. However, the metal fins 1010 will still direct air from the intermediate vent 122 the output vent 130.

As noted above, in embodiments such as the one shown in FIG. 10, the inactive portions 153, 780 of an air-conditioning coil 150, 750 can be configured in a similar manner to the active portions 156, 755. This can simplify the manufacture of the air-conditioning coil 150, 750 by allowing the same or a similar manufacturing process for both active portions 156, 755 and inactive portions 153, 780.

Figure 11:
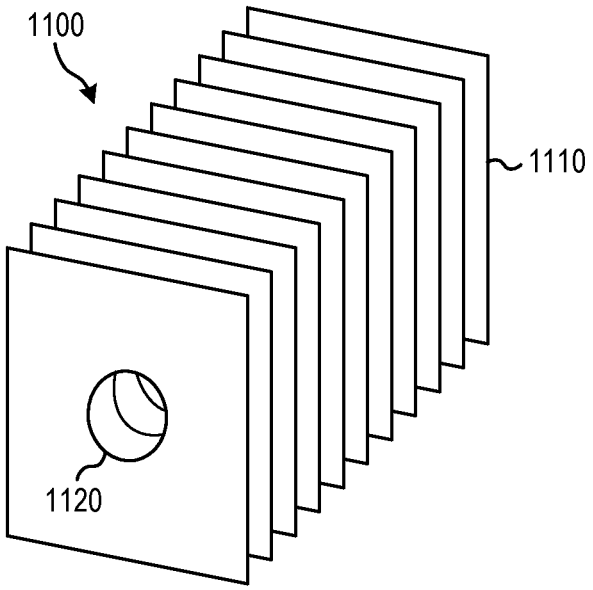
FIG. 11 is an illustration of a plurality of metal fins with no refrigerant tube passing through them for use in an indoor air-conditioning unit according to alternate disclosed embodiments.

FIG. 11 is an illustration 1100 of a plurality of metal fins 1110 with no refrigerant tube passing through them for use in an indoor air-conditioning unit according to alternate disclosed embodiments.

As shown in FIG. 11, the plurality of metal fins 1110 are arranged in a substantially parallel configuration that allows air to pass between them.

In the embodiment of FIG. 11, the metal fins 1110 each include one or more holes 1120 through which a refrigerant tube could pass were refrigerant tubes 160 included in the inactive portions 153, 780. This simplifies the manufacture of the inactive portions 153, 780 by allowing the same metal fins 1010 that would be used in the active portions 156, 755 to be used as the metal fins 1110 on the inactive portions 153, 780. However, this is by way of example only. Alternate embodiments can use metal fins 1110 that do not have holes 1120 formed in them.

Although FIG. 11 shows that each metal fin 1010 includes only one hole 1120, a metal fin 1010 may, in fact, be much larger than illustrated in FIG. 11 and may have many holes 1020 in it.

FIG. 11 shows a configuration that can be used in inactive portions 153, 780 of an air-conditioning coil 150, 750 with both active portions 156, 755 and inactive portions 153, 780 according to certain embodiments. Since no refrigerant is run through the inactive portion 153, 780, there is no actual need for the refrigerant tubes 160. Therefore, they may be omitted in some embodiments.

As shown in the embodiment of FIG. 11, an inactive portion 153, 780 includes only a plurality of substantially parallel metal fins 1110 arranged to guide return air through the inactive portion 153, 780 from the intermediate vent 122 the output vent 130. This can potentially reduce the cost and complexity of the inactive portions 153, 780 by eliminating the need for refrigerant tubes 160.

Methods of Operation

Figure 12:
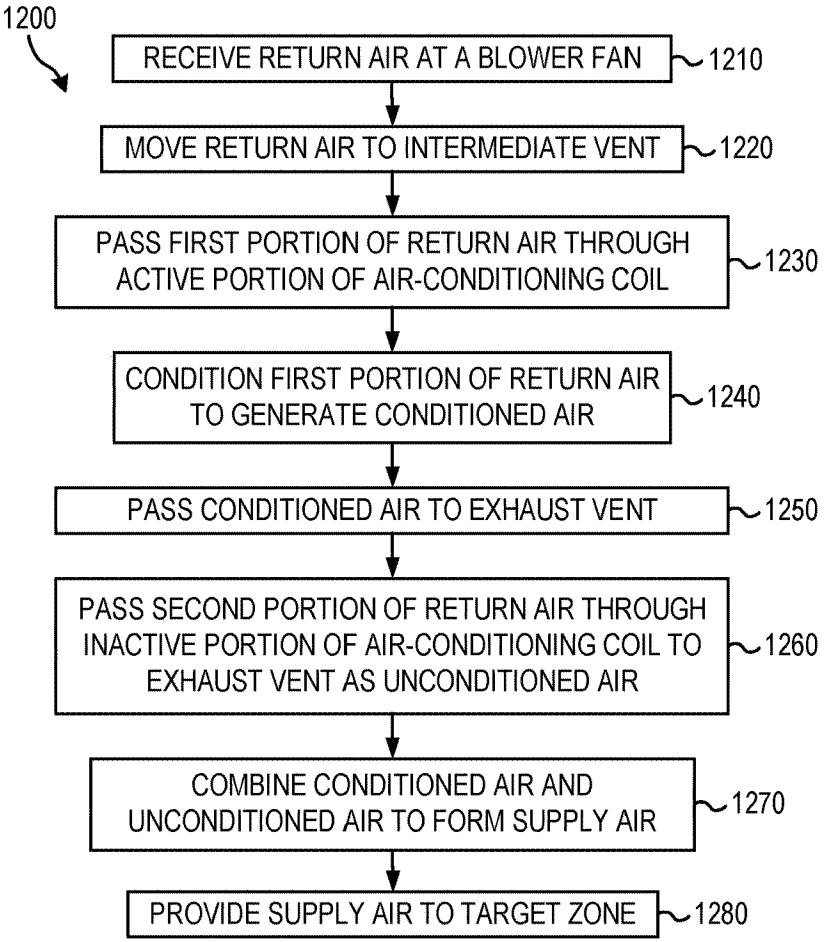
FIG. 12 is a flow chart of the operation of an indoor air-conditioning unit having an air-conditioner coil with an active portion and an inactive portion according to disclosed embodiments.

FIG. 12 is a flow chart of the operation 1200 of an indoor air-conditioning unit having an air-conditioner coil with an active portion and an inactive portion according to disclosed embodiments.

As shown in FIG. 12, and air-conditioning operation 1200 begins when an air-conditioning unit receives return air at a blower fan (1210).

The blower fan then moves the return air into an intermediate vent (1220).

A first portion of the return air is then passed from the intermediate vent through an active portion of an air-conditioning coil (1230), the first portion of the return air is conditioned in the active portion of the air-conditioning coil to generate conditioned air (1240), and the conditioned air is supplied to an exhaust or output vent (1250). The conditioning can include heating the first portion of the return air in a heating mode or cooling the first portion of the return air in a cooling mode, as appropriate. This conditioning can also include dehumidifying the first portion of the return air.

A second portion of the return air is then passed through an inactive portion of the air-conditioning coil to the exhaust or output vent as unconditioned air (1260). The return air passing through the inactive portion of the air-conditioning coil is not conditioned during this passage.

The conditioned air and the unconditioned air are then combined to form supply air (1270). This combination can be performed by simply passing both the conditioned air and the unconditioned air into the same output vent, or it can be performed by actively mixing the two airflows together to even out the temperature and humidity of the conditioned air and the unconditioned air.

Finally, the supply air is provided to a target zone (1280). This target zone can be a room or set of rooms whose temperature the air-conditioning unit is tasked to regulate.

Figure 13:
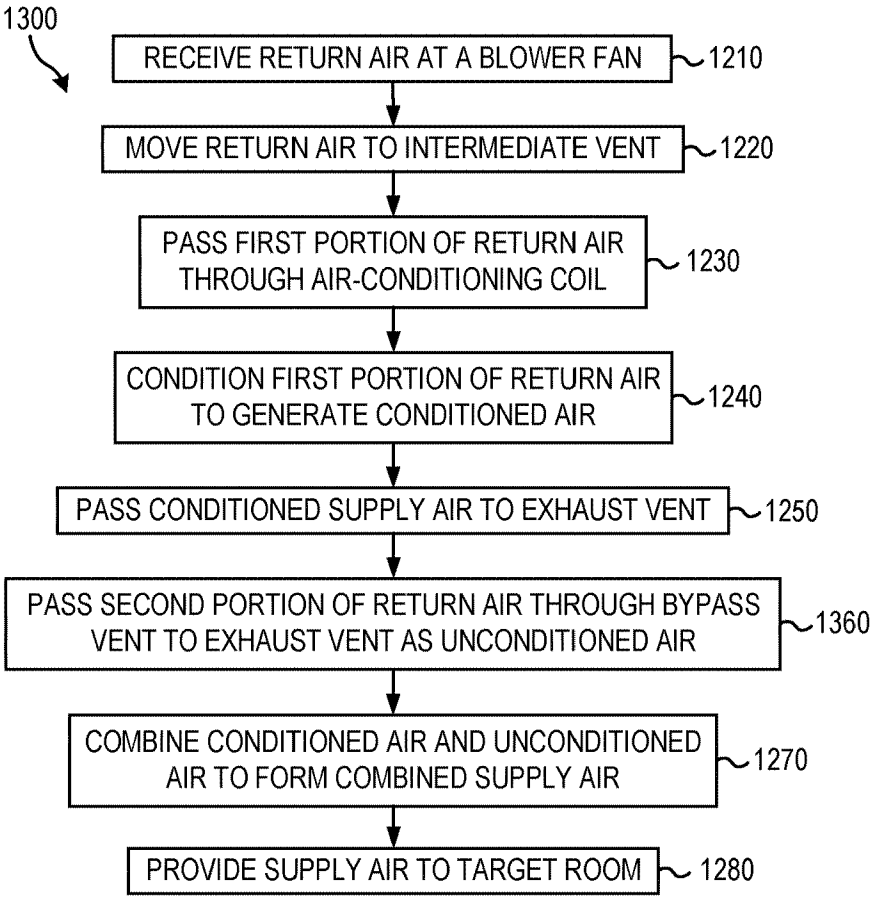
FIG. 13 is a flow chart of the operation of an indoor air-conditioning unit having an air-conditioner coil and a bypass vent according to disclosed embodiments.

FIG. 13 is a flow chart of the operation 1300 of an indoor air-conditioning unit having an air-conditioner coil and a bypass vent according to disclosed embodiments.

As shown in FIG. 13, and air-conditioning operation 1300 begins when an air-conditioning unit receives return air at a blower fan (1210).

The blower fan then moves the return air into an intermediate vent (1220).

A first portion of the return air is then passed through an active portion of an air-conditioning coil (1230), the first portion of the return air is conditioned in the active portion of the air-conditioning coil to generate conditioned air (1240), and the conditioned air is supplied to an exhaust or output vent (1250). The conditioning can include heating the first portion of the return air in a heating mode or cooling the first portion of the return air in a cooling mode, as appropriate. This conditioning can also include dehumidifying the first portion of the return air.

A second portion of the return air is then passed through a bypass vent to the exhaust or output vent as unconditioned air (1360). The return air passing through the bypass vent is not conditioned during this passage.

The conditioned air and the unconditioned air are then combined to form supply air (1270). This combination can be performed by simply passing both the conditioned air and the unconditioned air into the same output vent, or it can be performed by actively mixing the two airflows together to even out the temperature and humidity of the conditioned air and the unconditioned air.

Finally, the supply air is provided to a target zone (1280). This target zone can be a room or set of rooms whose temperature the air-conditioning unit is tasked to regulate.

Conclusion

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed:

1. An air-conditioning unit, comprising:
an input vent configured to receive return air;
an intermediate vent;
an output vent;
a blower fan configured to move the return air from the input vent to the intermediate vent; and
an air-conditioner coil located between the intermediate vent and the output vent including
an active portion including one or more operational coil circuits configured to receive a first portion of the return air from the intermediate vent, to circulate a refrigerant, to condition the first portion of the return air by heat exchange with the refrigerant to create conditioned air, and to pass the conditioned air to the output vent, and
an inactive portion that does not circulate the refrigerant and that is configured to pass a second portion of the return air as unconditioned air to the output vent,
wherein
the conditioned air and the unconditioned air are passed through the output vent as supply air, and
no connection exists between any part of the inactive portion and a supply pipe for refrigerant.

2. The air-conditioning unit of claim 1, wherein
the active portion includes two or more operational coil circuits,
each of the two or more operational coil circuits includes a plurality of active coil sections, and
each of the plurality of active coil sections includes a plurality of operational refrigerant tubes connected together and configured to pass refrigerant.

3. The air-conditioning unit of claim 1, wherein
the conditioned air and the unconditioned air are mixed together to form the supply air.

4. The air-conditioning unit of claim 1, further comprising:
an air mixer configured to mix the unconditioned air and the conditioned air to generate the supply air.

5. The air-conditioning unit of claim 1, wherein
the active portion includes two or more operational coil circuits, and
the inactive portion does not include any coil sections.

6. The air-conditioning unit of claim 1, wherein
the blower fan is located upstream from the air-conditioning coil in an air flow from the input vent to the output vent.

7. The air-conditioning unit of claim 1, wherein
each of the one or more operational coil circuits includes a plurality of active coil sections, and
each of the plurality of active coil sections includes a plurality of operational refrigerant tubes connected together and configured to pass refrigerant.

8. The air-conditioning unit of claim 7, wherein
each of the plurality of active coil sections includes a same number of operational refrigerant tubes.

9. The air-conditioning unit of claim 1, wherein
the active portion includes
a plurality of first conductive fins arranged in a substantially parallel arrangement, and
at least one active coil configured to pass through the plurality of first conductive fins, configured to be in a conductive relationship with the plurality of first conductive fins, and configured to circulate refrigerant,
the inactive portion includes a plurality of second conductive fins arranged in a substantially parallel arrangement, and
no coils pass through the plurality of second conductive fins.

10. The air-conditioning unit of claim 9, wherein
the plurality of second conductive fins are each arranged as a solid sheet without holes.

11. The air-conditioning unit of claim 1, wherein
the active portion includes two or more operational coil circuits,
the inactive portion includes two or more inactive coil sections, and
each of the two or more inactive coil sections includes at least one non-operational refrigerant tube that does not pass refrigerant.

12. The air-conditioning unit of claim 11, wherein
the at least one non-operational refrigerant tube in each of the two or more inactive coil sections is not connected to a refrigerant supply.

13. The air-conditioning unit of claim 11, wherein
the at least one non-operational refrigerant tube in each of the two or more inactive coil sections is connected to a refrigerant supply but is configured such that the refrigerant is disabled from flowing through the at least one non-operational refrigerant tube.

14. An air-conditioning unit, comprising:
an input vent configured to receive return air;
an intermediate vent;
an output vent;
a blower fan configured to move the return air from the input vent to the intermediate vent; and
an air-conditioner coil located between the intermediate vent and the output vent including
an active portion configured to receive a first portion of the return air from the intermediate vent, to circulate a refrigerant, to condition the first portion of the return air by heat exchange with the refrigerant to create conditioned air, and to pass the conditioned air to the output vent, and
an inactive portion that does not circulate the refrigerant and that is configured to receive a second portion of the return air and pass the second portion of the return air as unconditioned air to the output vent,
wherein
the conditioned air and the unconditioned air are passed through the output vent as supply air,
the active portion includes two or more active segments arranged in parallel, each active segment providing a separate active refrigerant path through the air-conditioner coil, and
the inactive portion includes two or more inactive portions arranged in parallel, each inactive segment providing a separate inactive refrigerant path through the air-conditioner coil, and
no connection exists between any part of the inactive portion and a supply pipe for refrigerant.

15. The air-conditioning unit of claim 14, wherein
each active segment includes a plurality of refrigerant tubes configured to pass the refrigerant.

16. The air-conditioning unit of claim 14, wherein
each active segment is substantially the same size.

17. The air-conditioning unit of claim 14, wherein
the two or more active segments are grouped together, and
the two or more inactive segments are grouped together.

18. The air-conditioning unit of claim 14, wherein
each of the two or more active segments has substantially the same arrangement of components.

19. The air-conditioning unit of claim 18, wherein
each of the two or more inactive segments has substantially the same arrangement of components,
each of the two or more inactive segments has a substantially same arrangement of components as each of the two or more inactive segments, except that the two or more inactive segments are configured not to distribute the refrigerant.

20. An air-conditioning unit, comprising:
an input vent configured to receive return air;
an intermediate vent;
an output vent;
a blower fan configured to move the return air from the input vent to the intermediate vent; and
an air-conditioner coil located between the intermediate vent and the output vent including
an active portion including a first section of the air-conditioning coil configured to receive a first portion of the return air from the intermediate vent, to circulate a refrigerant, to condition the first portion of the return air by heat exchange with the refrigerant to create conditioned air, and to pass the conditioned air to the output vent, and
an inactive portion including a second section of the air-conditioning coil that does not circulate the refrigerant and that is configured to pass a second portion of the return air as unconditioned air to the output vent,
wherein the conditioned air and the unconditioned air are passed through the output vent as supply air, and
no connection exists between any part of the inactive portion and a supply pipe for refrigerant.

* * * * *